US005147066A

United States Patent [19]

Snider

[11] Patent Number: 5,147,066

[45] Date of Patent: Sep. 15, 1992

[54] CHILD'S OR INFANT'S DRINKING CUP ASSEMBLY WITH DUAL LOCKING MECHANISMS

[76] Inventor: Donna Snider, 3381 W. Newark, Lapeer, Mich. 48446

[21] Appl. No.: 746,897

[22] Filed: Aug. 19, 1991

[51] Int. Cl.[5] ..... A47G 19/22

[52] U.S. Cl. ..... 220/717; 220/703; 220/705; 220/711; 220/716

[58] Field of Search ..... 220/90.2, 90.4, 85 SP, 220/703–718; 215/213, 216, 218, 221; 222/566, 567, 568, 570

[56] References Cited

U.S. PATENT DOCUMENTS

| | | | |
|---|---|---|---|
| 4,241,856 | 12/1980 | Otterson | 220/85 SP X |
| 4,358,031 | 11/1982 | Lohrman | 215/217 X |
| 4,388,996 | 6/1983 | Panicci | 220/90.4 X |
| 4,572,385 | 2/1986 | Luker | 215/218 X |
| 4,850,496 | 7/1989 | Rudell et al. | 220/90.2 X |

*Primary Examiner*—Stephen Marcus
*Assistant Examiner*—Paul A. Schwarz
*Attorney, Agent, or Firm*—Gifford, Groh, Sprinkle, Patmore and Anderson

[57] ABSTRACT

A child's or infant's drinking cup assembly having a cup portion and a lid portion and having means for engaging the portions with each other. The cup portion has a cup cavity and means for engaging said lid portion. The lid portion has a spout and a spout chamber with access holes for sipping from the fluidic contents of the cup when the lid portion is engaged to the cup portion. Lock mechanisms are provided on an upper cylindrical surface of the lid portion for the purpose of engaging stops on an annular surface of the cup portion. When the lid portion is engaged and lockingly fitted to the cup portion, the lock mechanisms maintain the lid portion in engagement with the cup portion and prevent removal of the lid portion by a baby or child.

9 Claims, 1 Drawing Sheet

CHILD'S OR INFANT'S DRINKING CUP ASSEMBLY WITH DUAL LOCKING MECHANISMS

BACKGROUND OF THE INVENTION

1. Field of the Invention

The present invention relates to drinking cups. More particularly, the present invention relates to a drinking cup assembly designed for use by a child or an infant. The drinking cup assembly comprises two portions; one portion being the cup portion, and the other portion being the lid portion. The lid portion has access holes for sipping the cup contents.

2. Description of the Prior Art

Parents and other child care providers have long sought a suitable drinking cup that allows an infant or a child to sip the liquid from a cup and yet prevent removal by the child of the lid and shortly thereafter the entire contents of the cup. A conventional cup of this type does not provide much of this desired prevention that is sought.

Raising a child can be a nerve-wracking experience. One of the most challenging tasks for the adult is letting the child learn to feed him/herself. The child usually learns to drink form a restricted flow cup generally known as a sipping cup, but the child also quickly learns that the top of the sipping cup can be unscrewed and the contents dumped on the highchair tray or the floor. Little children quickly discover that this behavior is fun as it irritates the parent or the supervising adult.

In the effort to overcome the problems of known provisions for children's drinking cups, modification of the basic drinking cup have been attempted.

U.S. Pat. Nos. 4,850,496 to Rudell et al discloses a container for liquids. The cap of the container has a drinking spout similar to those on a child's drinking cup and as an alternative to a threaded connection it has a pair of twist locks or a bayonet type of connection as illustrated in FIGS. 6 and 7. However, these locks are not childproof and can be opened by a simple rotation of the cap containing the spout.

An attempt at preventing any access by a child is disclosed in U.S. Pat. No. 4,358,031 to Lohrman, issued Nov. 9, 1982. This patent is directed toward preventing a child from attaining any access to the contents of the container. The safety closure has a pair of lock tabs which prevent rotation of the tab to unscrew it. The lock tabs are released by squeezing the closure skirt.

While providing some measure of protection by controlling accessibility of a child to contents of a container, these devices all suffer from common defects, including the lack of a childproof lock but yet still allowing partial flow while preventing full flow, as when the cap is totally removed.

Accordingly, the problem of spillable infant's and children's drinking cups has not been successfully addressed by prior inventions.

The object of the present invention is to provide a children's or infant's drinking cup assembly that has the beneficial qualities of a cup assembly that allows the child or infant to drink and yet does not allow the child to remove the lid and spill the entire contents out of the drinking cup.

SUMMARY OF THE PRESENT INVENTION

The present invention overcomes those problems commonly associated with children's drinking cups while providing a practical child's drinking cup that allows a child or infant fluid accessibility through access holes for sipping from the cup's fluidic contents and yet prevents removal of the entire cap by the child.

In accordance with the present invention, an infant's or children's drinking cup is comprised of a lid portion and a cup portion suitably engaging each other. Lock mechanisms are provided on opposite sides of an upper cylindrical surface of the lid portion to readily and lockingly engage stops on the cup portion. Both the lid portion and the cup portion can be formed of a durable plastic material.

The lid portion of the drinking cup assembly has a spout with access holes for sipping to allow controlled access to the cup cavity when the lid portion is assembled to the cup portion. The lock mechanism, which are diametrically opposed on the upper cylindrical surface of the lid portion, each have a cam surface and a planar surface; there is a connector from the cam surface to the upper cylindrical surface of the lid on one end of the cam surface and, on the other end of the cam surface, there is a flexible web also attaching the lock mechanism to the upper cylindrical surface of the lid portion. The flexible web allows the end of the lock mechanism having the flexible web to be compressed radially closer in towards the upper cylindrical surface of the lid portion. When both of the lock mechanisms are simultaneously compressed radially in towards the upper cylindrical surface of the lid portion, the lid portion can be rotated in a clockwise or counterclockwise direction. As the lid portion is rotated in a clockwise direction, each of the cam surfaces automatically depress against and bypass the stops. When rotated in a counterclockwise direction, the lock mechanisms must be compressed in order to clear the stops on the cup portion to allow the lid portion to be disassembled from the cup portion.

The cup portion has a cup cavity therein and a cup wall thickness through most of the cup between the cup cavity and the outside wall of the cup. At the top of the cup, there is a flange and an annular surface normal to and on top of the flange. The flange at the top of the cup cavity has an inside cylindrical surface containing internal threads. Stops are diametrically disposed to each other on the annular surface. Each stop has a tapered portion behind it to strengthen it.

The lid portion is assembled to the cup portion by engaging the external threads of the lid portion, by rotating the lid portion in a clockwise direction, to the mating internal threads of the cup portion and optionally simultaneously compressing the lock mechanisms against the cam surfaces in order to press the cam surface radially closer towards the upper cylindrical surface of the lid portion. This allows the lock mechanisms to radially clear the stops while the lid is being rotationally turned into threaded engagement with the cup. The lock mechanisms are designed to yield to an adult's finger pressure. The coordination required is generally above a level which an infant or a child could exhibit because both cam surfaces on the opposing lock mechanisms must be compressed at the same time while the lid is being rotated counterclockwise to disassemble the lid portion from the cup portion.

Because the lid portion forms a childproof connection to the cup portion, no large flow from the cup cavity can occur. Only the volume of fluid flow through the access holes as controlled by the size of the holes is allowed.

Other advantages and features of the present invention will become more apparent from the following detailed description when read in conjunction with the accompanying drawing.

BRIEF DESCRIPTION OF THE DRAWING

The present invention will be more fully understood by reference to the following detailed description of the preferred embodiments of the present invention when read in conjunction with the accompanying drawing, in which like reference characters refer to like parts throughout the views, and in which.

DETAILED DESCRIPTION OF THE PREFERRED EMBODIMENTS OF THE PRESENT INVENTION

Figure 1:
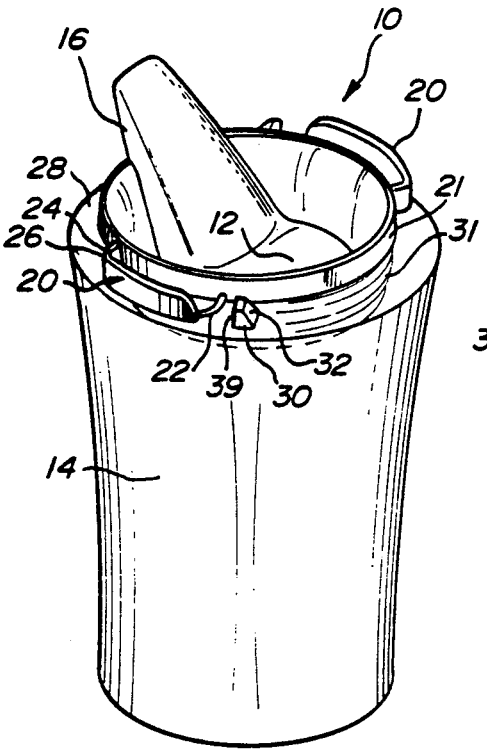
FIG. 1 is a perspective view illustrating a drinking cup assembly according to the present invention.

The drawing discloses the preferred embodiments of the present invention. While the configurations according to the illustrated embodiments are preferred, it is envisioned that alternate configurations of the present invention may be adopted without deviating from the invention as portrayed. The preferred embodiments are discussed hereinafter.

FIG. 1 is a perspective view of the drinking cup assembly. The drinking cup assembly, generally indicated as 10, comprises a lid portion 12 and a cup portion 14. The lid portion 12 and the cup portion 14 are preferably composed of a hard material, such as plastic. The two portions, 12 and 14, are threadably engaged to one another by internal threads 34 on the cup portion 14 and external threads 36 on the lid portion 12.

Figure 3:
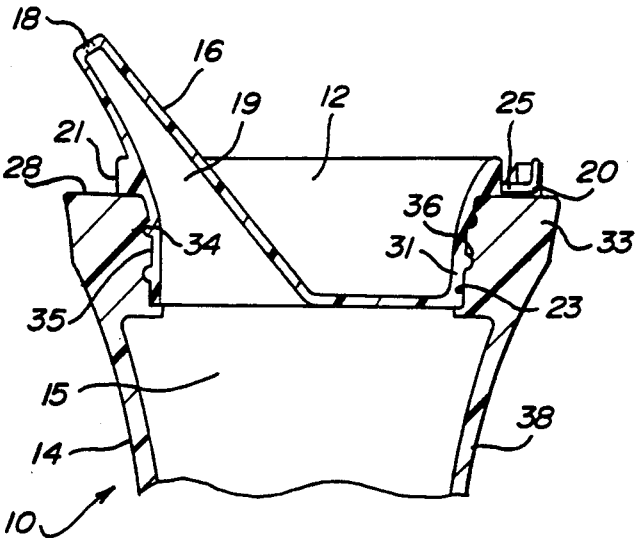
FIG. 3 is a sectional view of the top of the drinking cup assembly taken along line 3—3 of FIG. 2.

The lid portion 12 of the drinking cup assembly 10 includes a lid spout 16 having a spout chamber 19 therethrough it, as illustrated in the sectional view of FIG. 3. The spout chamber 19 connects to access holes 18 for sipping from the top of spout 16. The lid portion 12 has, located on its upper cylindrical surface 21, two lock mechanisms 20,20. The lock mechanisms 20,20 are diametrically opposed to each other and are attached to the upper cylindrical surface 21 of the lid portion 12.

Figure 2:
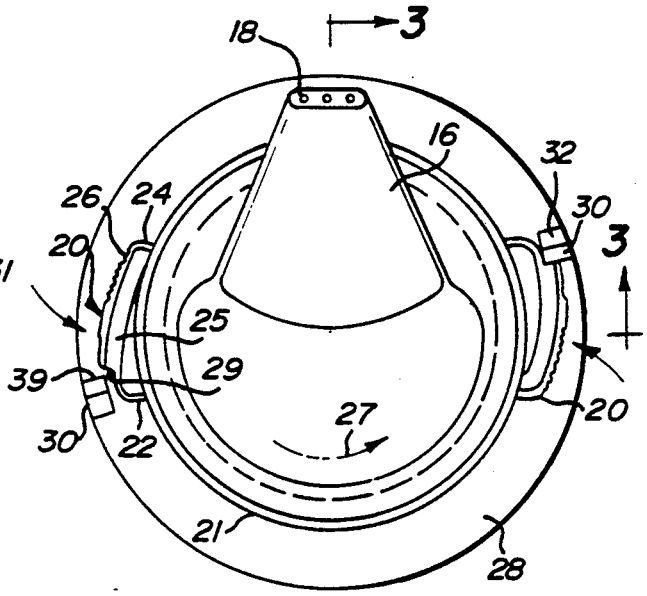
FIG. 2 is a top view illustrating the lid portion of the present invention in a locked position.

The lock mechanisms 20,20 are generally constructed as follows. The lock mechanism 20 has an arcuate cam surface 26 having two ends, one end being attached to the upper cylindrical surface 21 of the lid portion 12 by connector 24. The arcuate cam surface 26 has a planar stiffening rib 25 abutting it. A flexible web 22 at the other end of the arcuate cam surface 26 also connects the arcuate cam surface 26 to the upper cylindrical surface 21 of the lid portion 12. A generally radial stop surface 29 is formed at the upstream end of lock mechanism 20 in the direction of unthreading shown by arrow 27 in FIG. 2.

FIG. 1 also shows the cup portion 14 of the drinking cup assembly 10. The cup portion 14 has a radially extending annular surface 28 at the top of the cup portion 14. A stop 30 is mounted on the radially extending annular surface 28. The stop 30 has a tapered cam surface 32 and a radially extending stop surface 39. As better shown in FIG. 2, there are two stops 30,30 diametrically opposed to each other across the radially extending annular surface 28.

FIG. 3 is a partial side view of the drinking cup assembly 10 shown in cross-section. FIG. 3 shows the details of the mating relation between the lid portion 12 and the cup portion 14.

The lid portion 12 has external threads 36 formed on a lower cylindrical surface 31. The cup portion 14 has a generally cylindrical shaped wall 38 forming the cup cavity 15. There is an inwardly directed flange 33 at the top of the cup portion 14. An annular surface 28 is at the top of and is normal to the flange 33. The flange 33 has internal threads 34 formed in the internal surface 35 of the flange 33.

The lid portion 12 as shown in FIG. 3 engaged to the cup portion 14, allows the spout chamber 19 to connect the cup cavity 15 with the access holes 18 for sipping through the spout 16.

The essential feature of the drinking cup assembly according to the present invention is the ability to lock the lid portion 12 to the cup portion 14 in a childproof manner, and yet still allow controlled flow through the access holes 18. The lock mechanisms 20,20 provide this ability to lock the lid portion 12 to the cup portion 14.

Figure 4:
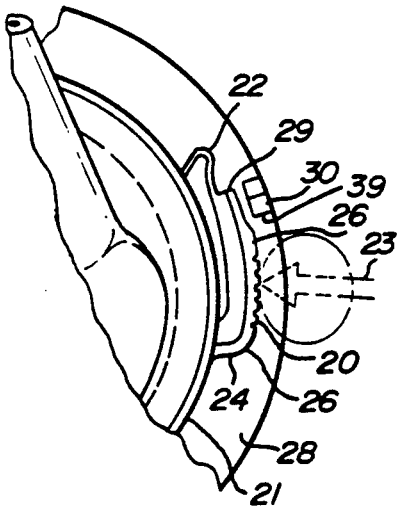
FIG. 4 is a partial view of FIG. 2, particularly showing the lock mechanism of the present invention.

Referring to FIG. 4, the lock mechanism 20 is shown in a radially depressed position created by force applied in the direction of arrow 23. When force is applied to the lock mechanism, the flexible web 22 comprises in a radial direction, thereby allowing the cam surface 26 to closely approach the upper cylindrical surface 21 of the lid portion 12. This allows the stop surface 29 of the lid lock mechanism 20 to clear the stop surface 39 of the cup stop 30. This depression of the cup lock mechanism 20 allows the lid portion 12 to be rotated in either a clockwise or counterclockwise direction to move the lock mechanism 20,20 relative to the stops 30,30 for either locking or unlocking the lid portion 12 for assembly or disassembly to or from the cup portion 14.

The lid portion 12 can be rotated in a clockwise direction without manually depressing the locking mechanism 20 because the engagement of the arcuate cam surface 26 of the lid lock mechanism with the sloped cam surface 32 of stop 30 will force the lock mechanism 20 inward to clear stop 30. The lid portion 12 thereafter cannot be rotated in a counterclockwise direction to remove the lid portion 12 without compressing the arcuate cam surfaces 26,26 of the lock mechanism 20,20 towards the upper cylindrical surface 21 of the lid portion 12. Therefore, the lid portion 12 is lockably held in threaded connection with the cup portion 14.

Having described my invention, it is envisioned that modifications may be made which nevertheless fall within the scope of the invention as claimed.

I claim:

1. A baby's or child's drinking cup assembly for containing fluids comprising:

a cup portion having a cavity to contain fluids;

a lid portion having an outside diameter and a spout with a spout chamber, said spout chamber having openings;

at least one of said openings of said spout chamber being an access hole for accessing fluid contained in said cavity of said cup portion;

means for engaging said lid portion to said cup portion;

said spout chamber of said lid portion connecting said at least one of said access holes with said cavity of said cup portion; and means for locking said lid portion to said cup portion, said means for locking having a stop mounted to said cup portion and a flexible web extending outwardly from said lid portion, said web engaging said stop to prevent rotation of said lid portion, said stop and said flexible web of said means for locking being positioned on said cup assembly between said means for engaging and said access hole of said spout.

2. The baby's or child's drinking cup assembly as claimed in claim 1 wherein said means for engaging said lid portion to said cup portion further comprises:

at least one thread formed on said cup portion; and at least one thread formed on said lid portion for engaging said at least one thread of said cup portion.

3. The baby's or child's drinking cup assembly as defined in claim 2 wherein:

said lid portion has a lower cylindrical surface;

said cup portion has an inwardly directed flange;

said lower cylindrical surface of said lid portion has said at least one thread formed thereon; and said inwardly directed flange of said cup portion has said at least one thread formed thereon.

4. The baby's or child's drinking cup assembly as claimed in claim 1 wherein said lid portion has at least one cylindrical surface having said flexible web attached thereto; and said cup portion has an annular surface having said at least one stop attached thereto.

5. The baby's or child's drinking cup assembly as defined in claim 4 wherein said locking mechanism further comprises:

an arcuate cam surface having two ends, one end being connected to said cylindrical surface of said lid portion by a connector;

a planar stiffening rib attached to said arcuate cam surface;

said flexible web having two ends, one end being connected to the other end of said arcuate cam surface and the other end connected to said cylindrical surface of said lid portion.

6. The baby's or child's drinking cup assembly as defined in claim 5 wherein said arcuate cam surface of said lock mechanism has a frictional surface.

7. The baby's or child's drinking cup assembly as claimed in claim 6 wherein when said arcuate cam surface is radially compressed towards said cylindrical surface of said lid portion, said lid can be rotated to move said lock mechanism past said stop on said annular surface of said cup portion.

8. The baby's or child's drinking cup assembly as claimed in claim 7 wherein said stop has a sloped cam surface for engaging and automatically radially depressing said arcuate cam surface as said cap is being rotated.

9. A baby's or child's drinking cup assembly for containing and dispensing fluids comprising:

a cup portion having a fluid holding cavity and an upwardly facing annular top surface;

said annular to surface of said cup portion having at least two stops;

a lid portion having a spout and a spout chamber;

said spout having at least one access hole;

means for engaging said lid portion to said cup portion;

said spout chamber of said lid portion providing a passage between said at least one access hole and said fluid holding cavity; and means for locking said lid portion to said cup portion, said means for locking comprising at least two locking mechanisms on said lid portion;

one of said at least two locking mechanisms on said lid portion lockingly engaging one of said at least two stops on said annular top surface of said cup portion;

another of said at least two locking mechanisms on said lid portion lockingly engaging another of said at least two stops on said annular top surface of said cup portion.

* * * * *

UNITED STATES PATENT AND TRADEMARK OFFICE

CERTIFICATE OF CORRECTION

PATENT NO. : 5,147,066

DATED : Sep. 15, 1992

INVENTOR(S) : Donna Snider

It is certified that error appears in the above-identified patent and that said Letters Patent is hereby corrected as shown below:

Column 1, line 35, "Nos." should read --No.--.

Column 6, claim 9, line 22, "to" should read --top--.

Signed and Sealed this

Nineteenth Day of October, 1993

*Attest:*

*Attesting Officer*

Bruce Lehman

BRUCE LEHMAN

*Commissioner of Patents and Trademarks*